US009904190B2

(12) United States Patent
Dan et al.

(10) Patent No.: US 9,904,190 B2
(45) Date of Patent: Feb. 27, 2018

(54) TONER, IMAGE FORMING APPARATUS, IMAGE FORMING METHOD, AND PROCESS CARTRIDGE

(71) Applicants: Tatsuya Dan, Shizuoka (JP); Tohru Moriya, Shizuoka (JP); Tomomi Suzuki, Shizuoka (JP); Kohtaroh Ogino, Shizuoka (JP)

(72) Inventors: Tatsuya Dan, Shizuoka (JP); Tohru Moriya, Shizuoka (JP); Tomomi Suzuki, Shizuoka (JP); Kohtaroh Ogino, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/126,337

(22) PCT Filed: Feb. 2, 2015

(86) PCT No.: PCT/JP2015/053319

§ 371 (c)(1),
(2) Date: Sep. 15, 2016

(87) PCT Pub. No.: WO2015/141321

PCT Pub. Date: Sep. 24, 2015

(65) Prior Publication Data

US 2017/0082933 A1 Mar. 23, 2017

(30) Foreign Application Priority Data

Mar. 18, 2014 (JP) ..... 2014-055662
Jul. 24, 2014 (JP) ..... 2014-151057

(51) Int. Cl.

| | |
|---|---|
| ***G03G 9/087*** | (2006.01) |
| ***G03G 9/08*** | (2006.01) |
| ***G03G 9/097*** | (2006.01) |
| ***G03G 9/09*** | (2006.01) |
| ***G03G 15/08*** | (2006.01) |

(52) U.S. Cl.

CPC ..... *G03G 9/0821* (2013.01); *G03G 9/081* (2013.01); *G03G 9/08711* (2013.01); *G03G 9/08755* (2013.01); *G03G 9/08795* (2013.01); *G03G 9/0904* (2013.01); *G03G 9/09708* (2013.01); *G03G 9/09783* (2013.01); *G03G 15/0865* (2013.01)

(58) Field of Classification Search

CPC ..... G03G 9/08755
See application file for complete search history.

(56) References Cited

U.S. PATENT DOCUMENTS

| | | | | |
|---|---|---|---|---|
| 5,403,690 | A | 4/1995 | Kuramoto et al. | |
| 5,554,478 | A | 9/1996 | Kuramoto et al. | |
| 5,840,456 | A | 11/1998 | Tomita et al. | |
| 6,074,794 | A | 6/2000 | Fushimi et al. | |
| 6,303,258 | B1 | 10/2001 | Katoh et al. | |
| 6,335,137 | B1 * | 1/2002 | Suzuki | G03G 9/08795 399/252 |
| 6,406,826 | B1 | 6/2002 | Suzuki et al. | |
| 6,500,595 | B1 | 12/2002 | Mochizuki et al. | |
| 6,902,858 | B2 | 6/2005 | Mochizuki et al. | |
| 7,374,851 | B2 | 5/2008 | Nakayama et al. | |
| 7,504,188 | B2 | 3/2009 | Yamada et al. | |
| 9,448,501 | B2 * | 9/2016 | Inoue | G03G 9/0821 |
| 2002/0155366 | A1 | 10/2002 | Mochizuki et al. | |
| 2002/0160290 | A1 | 10/2002 | Sugiura et al. | |
| 2002/0181971 | A1 | 12/2002 | Mochizuki et al. | |
| 2003/0138718 | A1 | 7/2003 | Yagi et al. | |
| 2003/0152857 | A1 | 8/2003 | Sugiura et al. | |
| 2003/0165760 | A1 * | 9/2003 | Higuchi | G03G 9/08755 430/108.4 |
| 2003/0180643 | A1 | 9/2003 | Suzuki et al. | |
| 2003/0186154 | A1 | 10/2003 | Suzuki et al. | |
| 2003/0232266 | A1 | 12/2003 | Sugiura et al. | |
| 2004/0185361 | A1 * | 9/2004 | Yoshino | G03G 13/26 430/108.1 |
| 2005/0112488 | A1 | 5/2005 | Yamada et al. | |
| 2005/0287465 | A1 * | 12/2005 | Ohshima | G03G 15/75 430/123.43 |
| 2007/0003855 | A1 | 1/2007 | Veregin et al. | |
| 2007/0218383 | A1 | 9/2007 | Seshita et al. | |
| 2008/0076055 | A1 | 3/2008 | Sawada et al. | |

(Continued)

FOREIGN PATENT DOCUMENTS

| | | |
|---|---|---|
| EP | 2 648 045 A1 | 10/2013 |
| JP | 8-305082 | 11/1996 |
| JP | 8-305082 A | 11/1996 |
| JP | 2002-082484 | 3/2002 |
| JP | 2003-029462 | 1/2003 |
| JP | 2004-361663 | 12/2004 |
| JP | 2006-047743 | 2/2006 |
| JP | 2006-221151 | 8/2006 |
| JP | 2006-259312 | 9/2006 |
| JP | 2007-011347 | 1/2007 |
| JP | 2007-033773 | 2/2007 |
| JP | 2008-225419 | 9/2008 |
| JP | 2013-200559 | 10/2013 |
| JP | 2013-231945 | 11/2013 |

OTHER PUBLICATIONS

International Search Report dated Mar. 17, 2015 for counterpart International Patent Application No. PCT/JP2015/053319 filed Feb. 2, 2015.

Extended European Search Report dated Feb. 27, 2017 in Patent Application No. 15765573.9.

*Primary Examiner* — Hoa V Le

(74) *Attorney, Agent, or Firm* — Oblon, McClelland, Maier & Neustadt, L.L.P.

(57) ABSTRACT

A toner, including: a binder resin; and calcium carbonate, wherein the toner has a molecular weight distribution having a main peak in a range of 1,000 to 10,000, and a half value width of the main peak is 8,000 to 30,000, where the molecular weight distribution is obtained by GPC (gel permeation chromatography) of THF soluble matter of the toner, and wherein the toner contains the calcium carbonate in an amount of 5% by mass to 35% by mass.

7 Claims, 3 Drawing Sheets

(56) References Cited

U.S. PATENT DOCUMENTS

| | | | | |
|---|---|---|---|---|
| 2008/0096116 | A1 | 4/2008 | Utsumi et al. | |
| 2008/0213682 | A1 | 9/2008 | Saitoh et al. | |
| 2008/0227018 | A1 | 9/2008 | Awamura et al. | |
| 2008/0268366 | A1 | 10/2008 | Nakayama et al. | |
| 2008/0292361 | A1 | 11/2008 | Seshita et al. | |
| 2008/0311500 | A1 | 12/2008 | Yamada et al. | |
| 2009/0117480 | A1 | 5/2009 | Yamada et al. | |
| 2009/0142094 | A1 | 6/2009 | Sawada et al. | |
| 2009/0142682 | A1 | 6/2009 | Saitoh et al. | |
| 2009/0280421 | A1 | 11/2009 | Awamura et al. | |
| 2010/0119255 | A1 | 5/2010 | Seshita et al. | |
| 2013/0040235 | A1 | 2/2013 | Takatsuna | |
| 2013/0244162 | A1* | 9/2013 | Yamada ..... | G03G 9/08755 430/108.2 |
| 2013/0252160 | A1* | 9/2013 | Nagayama ..... | G03G 9/08755 430/108.2 |
| 2013/0260302 | A1* | 10/2013 | Nakajima ..... | G03G 9/08755 430/108.2 |
| 2013/0260307 | A1 | 10/2013 | Nagayama et al. | |
| 2014/0363209 | A1 | 12/2014 | Inoue et al. | |

* cited by examiner

TONER, IMAGE FORMING APPARATUS, IMAGE FORMING METHOD, AND PROCESS CARTRIDGE

TECHNICAL FIELD

The present invention relates to an electrostatic developing toner (hereinafter may be referred to as "toner") used for a so-called electrophotographic image forming (e.g., an electrostatic copier or a laser beam printer); and an image forming apparatus, an image forming method, and a process cartridge using the toner.

BACKGROUND ART

Conventionally, in an electrophotographic device or an electrostatic recording device, an electric latent image or a magnetic latent image is visualized with a toner. For example, in electrophotography, an electrostatic latent image formed on a photoconductor is developed with a toner to form a toner image. The toner image is typically transferred onto a transfer material (e.g., paper), and then fixed upon application of heat.

In recent years, toners have been demanded to be fixed at lower temperatures. This demand results from energy saving achieved by reducing energy for fixing and also from requirements for increasing process speed and image quality of image forming apparatus. In addition, as a result of diversification of usage purposes of image forming apparatus, requirements for low-temperature fixing have been being increasing.

A toner can be fixed at lower temperatures by decreasing its softening temperature. However, decreasing the softening temperature decreases its glass transition temperature to impair heat resistance storage ability. In addition, hot offset resistance is also impaired due to a drop in the lower-limit fixing temperature (i.e., the lower-limit temperature at which fixing can be performed without causing problems on image quality) and to a drop in the upper-limit fixing temperature (i.e., the upper-limit temperature at which fixing can be performed). Therefore, it is difficult to achieve a toner that is satisfactory in all of low-temperature fixing property, heat resistance storage stability, and hot-offset resistance only by controlling a thermal property of the resin itself. There is a demand for providing a toner that is satisfactory in all of low-temperature fixing property, heat resistance storage stability, and hot-offset resistance and that allows to form a high-quality image for a long period of time.

For the purpose of achieving satisfactory low-temperature fixing property, heat resistance storage stability, and hot-offset resistance, for example, there is disclosed a toner containing a crystalline polyester, a non-crystalline polyester, and an inorganic nucleating agent (e.g., see PTL 1).

There is also disclosed a toner which contains a binder resin and has a molecular weight distribution having at least one peak in a range of 1,000 to 10,000 and a half value width of 15,000 or less, where the molecular weight distribution is obtained by GPC of THF soluble matter of the toner (e.g., see PTL 2).

Furthermore, there is disclosed a toner which contains a crystalline polyester resin and has a molecular weight distribution having a main peak in a range of 1,000 to 10,000 and a half value width of 15,000 or less, where the molecular weight distribution is obtained by GPC of THF soluble matter of the toner (e.g., see PTL 3).

Meanwhile, there is disclosed a toner containing 0.01% by weight to 20% by weight of calcium carbonate (e.g., see PTLs 4 and 5). However, it has not been described that a combination with the above-described specific molecular weight distribution results in satisfactory low-temperature fixing property, heat resistance storage stability, and hot-offset resistance or that the calcium carbonate has an elasticity enhancing effect.

It is practically problematic that a manufacturing cost is increased in our rage for high quality. There is a practical demand for ensuring good quality while keeping the cost low, that is, for providing a toner which is satisfactory in low cost and high quality.

However, the above-disclosed methods cannot achieve a toner which is satisfactory in terms of practical use, that is, in economical and qualitative aspects (i.e., satisfactory in all of low-temperature fixing property, heat resistance storage stability, and hot-offset resistance), so that there is a room for further improvement in the methods.

CITATION LIST

Patent Literature

PTL 1 Japanese Patent Application Laid-Open (JP-A) No. 2007-33773
PTL 2 JP-A No. 2002-82484
PTL 3 JP-A No. 2013-231945
PTL 4 JP-A No. 2006-259312
PTL 5 JP-A No. 2006-47743

SUMMARY OF INVENTION

Technical Problem

The present invention has been made in view of the related art: That is, the first object of the present invention is to provide a toner being excellent in low-temperature fixing property, hot-offset resistance, and heat resistance storage stability.

Solution to Problem

Means for solving the above problems is as follows.

A toner, including:

a binder resin; and calcium carbonate, wherein the toner has a molecular weight distribution having a main peak in a range of 1,000 to 10,000, and a half value width of the main peak is 8,000 to 30,000, where the molecular weight distribution is obtained by GPC (gel permeation chromatography) of THF soluble matter of the toner, and wherein the toner contains the calcium carbonate in an amount of 5% by mass to 35% by mass.

Advantageous Effects of Invention

The present invention can solve the above existing problems and achieve the above object. Accordingly, the first object of the present invention can be achieved, that is, a toner being excellent in low-temperature fixing property, hot-offset resistance, and heat resistance storage stability can be provided.

DESCRIPTION OF EMBODIMENTS (Toner)

Figure 1:
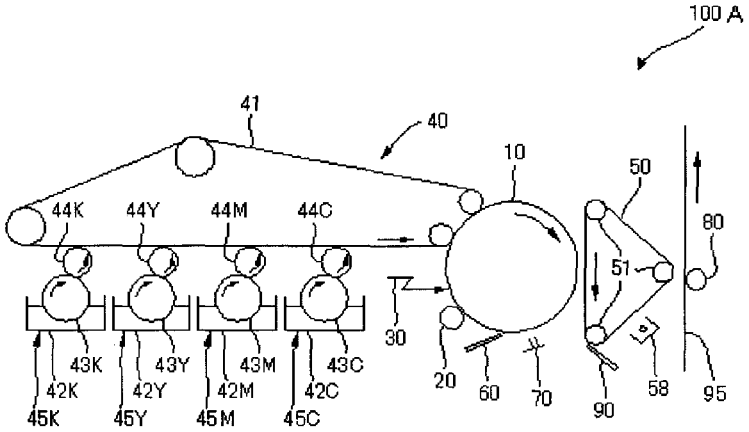
FIG. 1 is a schematic, structural view of one exemplary image forming apparatus of the present invention.

The first object of the present invention is to provide a toner being excellent in low-temperature fixing property, hot-offset resistance, and heat resistance storage stability. The second object of the present invention is to provide a toner having an improved low-temperature fixing property and being excellent in charging property. The below-described toner of the present invention is a toner achieving the first object and the second object.

A toner of the present invention includes a binder resin and calcium carbonate; and, if necessary, further includes a colorant, a release agent, and other ingredients.

Example of the other ingredients includes a charging controlling agent for assisting the charging property.

The present inventors have been found that, based on a technical idea in which a sharpening of a molecular weight distribution of a toner is useful for improving low-temperature fixing property, a toner can achieve excellent low-temperature fixing property through having a molecular weight distribution having a main peak in a range of 1,000 to 10,000, and a half value width of the main peak is 8,000 to 30,000, where the molecular weight distribution is obtained by GPC (gel permeation chromatography) of THF soluble matter of the toner.

When the main peak is in less than 1,000, hot-offset property and heat resistance storage stability are degraded. When the main peak is in more than 10,000, low-temperature fixing property is degraded. When the half value width is less than 8,000, hot-offset property is degraded. When the half value width is more than 30,000, low-temperature fixing property is degraded.

The half value width of the main peak is more preferably 8,000 to 20,000.

The main peak, as used herein, refers to a peak having the highest intensity.

The GPC (gel permeation chromatography) is performed as follows.

[Measurement of Molecular Weight Distribution]

A column is stabilized in a heat chamber at 40° C. As a solvent, THF is streamed into the column at this temperature at a flow velocity of 1 mL per minute, and a THF sample solution of a toner or resin in which a sample concentration has been adjusted to 0.05% by mass to 0.6% by mass, is injected at 50 μL to 200 μL for measurement.

In order to measure the molecular weight of the sample, the molecular weight distribution of the sample was calculated from the correlation between the logarithmic values and the number of counts of the standard curve that is prepared from the standard samples of various monodisperse polystyrenes.

As the standard polystyrene samples used for the standard curve, it is appropriate to use those with a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ manufactured by, for instance, Pressure Chemical Co. or TOSOH CORPORATION, and to use at least about ten standard polystyrene samples. An RI (refractive index) detector is used as a detector therefor.

A particle diameter of the toner is preferably 3 μm to 15 μm in terms of a volume average particle diameter. When the volume average particle diameter is smaller than 3 μm, there may be a problem in cleaning during a development process and transfer efficiencies during a transfer process, thus deteriorating image quality. When the volume average particle diameter is larger than 15 μm, the image quality may deteriorate.

The volume average particle diameter of the toner can be measured by various methods. For example, it can be measured using COULTER COUNTER TAII (manufactured by U.S. COULTER ELECTRONICS Co.).

<Binder Resin>

The binder resin is not particularly limited and may be appropriately selected from conventionally known materials, as long as the toner has a molecular weight distribution having a main peak in a range of 1,000 to 10,000, and a half value width of the main peak is 8,000 to 30,000, where the molecular weight distribution is obtained by GPC (gel permeation chromatography) of THF soluble matter of the toner. The binder resin is more preferably a combination of a resin (A), a resin (B), and a composite resin (C) as described below.

<<Resin (A)>>

A resin (A) used in the present invention is not particularly limited and may be appropriately selected from conventionally known materials, as long as a toner which contains a binder resin containing the resin (A) in combination with the below-described resin (B) and composite resin (C) has the above desired molecular weight distribution.

The resin (A) effectively functions to develop good hot-offset resistance.

When the resin (A) is contained in an excessively large amount, low-temperature fixing property is degraded. When the resin (A) is contained in an excessively small amount, satisfactory hot-offset resistance cannot be achieved. Therefore, the resin (A) should be incorporated in view of a balance with other binder resins.

The resin (A) has preferably a softening temperature (T½) higher than that of the below-described resin (B). The softening temperature (T½) of the resin (A) is preferably in a range of 120° C. to 180° C.

Herein, the softening temperature (T½) of a resin is measured as follows.

[Measurement of Softening Temperature (T½)]

The softening temperature (T½) of the resin can be measured using an elevated flow tester CFT-500 (manufactured by Shimadzu Corporation, Ltd.) by melting and flowing a sample of 1 $cm^2$ under the conditions: the diameter of a die hole: 1 mm, the pressure applied: 20 $kg/cm^3$ and the temperature raising rate: 6° C./min. The softening temperature (T½) is a temperature corresponding to ½ of the range between a flow start point and a flow end point.

<<Resin (B)>>

The resin (B) is not particularly limited and may be appropriately selected, as long as the toner has a molecular weight distribution having a main peak in a range of 1,000 to 10,000, and a half value width of the main peak is 8,000 to 30,000, where the molecular weight distribution is obtained by GPC of THF soluble matter of the toner. Preferable is that the resin (B) has preferably a molecular weight distribution having a main peak in a range of 1,000 to 10,000, and a half value width of the main peak is 8,000 to 30,000, where the molecular weight distribution is obtained by GPC of THF soluble matter of the resin (B). More preferable is that the half value width of the main peak is 8,000 to 20,000.

The resin (B) effectively functions to develop good fixing property.

When the main peak is in less than 1,000, hot-offset property and heat resistance storage stability are degraded. When the main peak is in more than 10,000, low-temperature fixing property is degraded. When the half value width is less than 8,000, hot-offset property is degraded. When the half value width is more than 30,000, low-temperature fixing property is degraded.

In a toner produced by combining the resin (A), the resin (B) and the composite resin (C) together, when the proportion of the resin (B) is increased, the best balance thereamong is obtained; i.e., the respective resins effectively exhibit their functions without accompanying adverse effects of the composite resin (C) on a lower-limit fixing temperature of the toner, so that the toner becomes good in low-temperature fixing property, heat resistance storage stability and hot offset resistance. However, when the resin (B) is contained in an excessively large amount, the resin oozes out during heat resistance storage, leading to poor heat resistance storage stability.

More preferably, the resin (B) has the softening temperature (T½) of 10° C. or more lower than that of the resin (A). The softening temperature (T½) of the resin (B) is preferably in a range of 70° C. to 120° C.

In the present invention, the resin (A) and the resin (B) have separate functions. For example, the resin (B) contributes to low-temperature fixing property (i.e., the lower limit fixing temperature), and the resin (A) contributes to hot-offset resistance (i.e., the upper limit fixing temperature).

The resin (A) and the resin (B) may be conventionally known materials, as long as the above functions can be exerted.

Examples thereof include styrene resins (homopolymers or copolymers including styrene or styrene-substituted products), vinyl chloride resins, styrene-vinyl acetate copolymers, rosin-modified maleic acid resins, phenol resins, epoxy resins, polyethylene resins, polypropylene resins, ionomer resins, polyurethane resins, silicone resins, ketone resins, ethylene-ethyl acrylate copolymers, xylene resins, polyvinyl butyral resins, petroleum resins and hydrogenated petroleum resins.

Examples of the styrene resins (homopolymers or copolymers including styrene or styrene-substituted products) include polystyrenes, polychiorostyrenes, poly(α-methylstyrenes), styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic acid ester copolymers (e.g., styrene-methyl acrylate copolymers, styrene-ethyl acrylate copolymers, styrene-butyl acrylate copolymers, styrene-octyl acrylate copolymers and styrene-phenyl acrylate copolymers), styrene-methacrylic acid ester copolymers (e.g., styrene-methyl methacrylate copolymers, styrene-ethyl methacrylate copolymers, styrene-butyl methacrylate copolymers and styrene-phenyl methacrylate copolymers), styrene-α-chloromethyl acrylate copolymers and styrene-acrylonitrile-acrylic acid ester copolymers.

Methods for producing these resins are not particularly limited may be appropriately selected. Examples thereof include mass polymerization, solution polymerization, emulsion polymerization and suspension polymerization.

These resins may be used alone or in combination.

The resin (A) and the resin (B) used in the present invention are more preferably a polyester resin from the viewpoint of development of low-temperature fixing property. The polyester resin usable is, for example, one generally obtained through condensation polymerization between an alcohol component and a carboxylic acid component.

Examples of the alcohol component include glycols; ethylated bisphenols such as 1,4-bis(hydroxymethyl)cyclohexane and bisphenol A; and other divalent alcohol monomers and tri- or higher-hydric alcohol monomers.

Examples of the glycols include ethylene glycol, diethylene glycol, triethylene glycol and propylene glycol.

Examples of the carboxylic acid component include divalent organic acid monomers and tri- or higher-valent carboxylic acid monomers.

Examples of the divalent organic acid monomers include maleic acid, fumaric acid, phthalic acid, isophthalic acid, terephthalic acid, succinic acid and malonic acid.

Examples of the tri- or higher-valent carboxylic acid monomers 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane and 1,2,7,8-octanetetracarboxylic acid.

The polyester resin preferably has a glass transition temperature Tg of 55° C. or higher, more preferably 60° C. or higher, from the viewpoint of heat resistance storage stability.

The DSC for measuring an endothermic peak and the glass transition temperature Tg in the present invention is performed by raising the temperature at 10° C./min from 20° C. to 150° C. using a differential scanning calorimeter ("DSC-60"; manufactured by Shimadzu Corporation, Ltd.).

<<Composite Resin (C)>>

The composite resin (C) is a resin where a condensation polymerization monomer and an addition polymerization monomer are chemically bonded together (hereinafter may be referred to as "hybrid resin").

That is, the composite resin (C) contains a condensation polymerization unit and an addition polymerization unit.

The composite resin (C) can be obtained by allowing a mixture containing a condensation polymerization monomer and an addition polymerization monomer serving as raw materials to simultaneously undergo condensation polymerization reaction and addition polymerization reaction in the same reaction vessel, or to sequentially undergo condensation polymerization reaction and addition polymerization reaction in this order, or to sequentially undergo addition polymerization reaction and condensation polymerization reaction in this order.

Examples of the condensation polymerization monomer in the composite resin (C) include: polyhydric alcohol components and polyhydric carboxylic acid components forming polyester resin units; and multivalent carboxylic acid components, and amine components or amino acid components forming polyamide resin units or polyester-polyamide resin units.

Examples of dihydric alcohol components among the polyhydric alcohol components include 1,2-propanediol, 1,3-propanediol, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained through polymerization of cyclic ethers.

Examples of the diols obtained through polymerization of cyclic ethers include diols obtained through polymerization between bisphenol A and cyclic ethers (e.g., ethylene oxide and propylene oxide).

Examples of tri- or higher-hydric alcohol components among the polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane and 1,3,5-trihydroxybenzene.

Among them, from the viewpoint of providing the resin with heat resistance storage stability and mechanical strength, hydrogenated bisphenol A and alcohol components each having the bisphenol A skeleton such as diols obtained through polymerization between bisphenol A and cyclic ethers (e.g., ethylene oxide and propylene oxide) can be suitably used.

Examples of the multivalent carboxylic acid components include benzene dicarboxylic acids or anhydrides thereof, alkyl dicarboxylic acids or anhydrides thereof; unsaturated dibasic acids; and unsaturated dibasic acid anhydrides.

Examples of the benzene dicarboxylic acids or anhydrides thereof include phthalic acid, isophthalic acid and terephthalic acid.

Examples of the alkyl dicarboxylic acids or anhydrides thereof include succinic acid, adipic acid, sebacic acid and azelaic acid.

Examples of the unsaturated dibasic acids include maleic acid, citraconic acid, itaconic acid, alkenylsuccinic acid, fumaric acid and mesaconic acid.

Examples of the unsaturated dibasic acid anhydrides include maleic anhydride, citraconic anhydride, itaconic anhydride and alkenylsuccinic anhydride.

Examples of tri- or higher-valent carboxylic acid components among the multivalent carboxylic acid components include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylene carboxy) methane, 1,2,7,8-octanetetracarboxylic acid, Enpol trimer acid, or anhydrides thereof and partial lower alkyl esters of thereof.

Among them, from the viewpoints of heat resistance storage stability and mechanical strength of the resin, aromatic multivalent carboxylic acid compounds such as phthalic acid, isophthalic acid, terephthalic acid and trimellitic acid are suitably used.

Examples of the amine components or the amino acid components include diamines (D1), tri- or higher-valent polyamines (D2), amino alcohols (D3), aminomercaptans (D4), amino acids (D5), and amino-blocked products (D6) of the amines (D1) to (D5).

Examples of the diamines (D1) include aromatic diamines (e.g., phenylenediamine, diethyltoluenediamine and 4,4'-diaminodiphenylmethane), alicyclic diamines (e.g., 4,4'-diamino-3,3'-dimethyldicyclohexylmethane, diaminocyclohexane and isophoronediamine), and aliphatic diamines (e.g., ethylenediamine, tetramethylenediamine and hexamethylenediamine).

Examples of the tri- or higher-valent polyamines (D2) include diethylenetriamine and triethylenetetramine.

Examples of the amino alcohols (D3) include ethanolamine and hydroxyethylaniline.

Examples of the aminomercaptans (D4) include aminoethyl mercaptan and aminopropyl mercaptan.

Examples of the amino acids (D5) include aminopropionic acid, aminocaproic acid and ϵ-caprolactam.

Examples of the amino-blocked products (D6) of the amines (D1) to (D5) include ketimine compounds and oxazolidine compounds derived from the amines (D1) to (D5) and ketones (e.g., acetone, methyl ethyl ketone and methyl isobutyl ketone).

The ratio by mole of the condensation polymerization monomer component in the composite resin (C) is preferably 5 mol % to 40 mol %, more preferably 10 mol % to 25 mol %.

When the ratio by mole thereof is less than 5 mol %, dispersibility of the composite resin (C) in the polyester resin may be degraded. When it is more than 40 mol %, dispersibility of a release agent may tend to be degraded.

An esterification catalyst may be used in the condensation polymerization reaction. Any well-known and commonly used catalyst can be used therein.

The addition polymerization monomer in the composite resin (C) is not particularly limited and may be appropriately selected depending on the intended purpose. Preferred examples thereof include vinyl monomers.

Examples of the vinyl monomer include styrene vinyl monomers, vinyl acrylate monomers, vinyl methacrylate monomers, and other monomers forming other vinyl monomers or copolymers.

Examples of the styrene vinyl monomers include styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-4-dichlorostyrene, m-nitrostyrene, o-nitrostyrene and p-nitrostyrene.

Examples of the vinyl acrylate monomers include acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Examples of the vinyl methacrylate monomers include methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate and diethylaminoethyl methacrylate.

Examples of the other monomers forming other vinyl monomers or copolymers include monoolefins, polyenes, halogenated vinyls, vinyl esters, vinyl ethers, vinyl ketones, N-vinyl compounds, vinylnaphthalenes, acrylic or methacrylic acid derivatives, unsaturated dibasic acids, unsaturated dibasic acid anhydride, unsaturated dibasic acid monoesters, unsaturated dibasic acid esters, α,β-unsaturated acids, α,β-unsaturated acid anhydride, carboxyl group-containing monomers, (meth)acrylic acid hydroxyalkyl esters, and hydroxy group-containing monomers.

Examples of the monoolefins include ethylene, propylene, butylene and isobutylene.

Examples of the polyenes include butadiene and isoprene.

Examples of the halogenated vinyls include vinyl chloride, vinylidene chloride, vinyl bromide and vinyl fluoride.

Examples of the vinyl esters include vinyl acetate, vinyl propionate and vinyl benzoate.

Examples of the vinyl ethers, include vinyl methyl ether, vinyl ethyl ether and vinyl isobutyl ether.

Examples of the vinyl ketones include vinyl methyl ketone, vinyl hexyl ketone and methyl isopropenyl ketone.

Examples of the N-vinyl compounds include N-vinylpyrrole, N-vinylcarbazole, N-vinylindole and N-vinylpyrrolidone.

Examples of the acrylic or methacrylic acid derivatives include acrylonitrile, methacrylonitrile and acrylamide.

Examples of the unsaturated dibasic acids include maleic acid, citraconic acid, itaconic acid, alkenylsuccinic acid, fumaric acid and mesaconic acid.

Examples of the unsaturated dibasic acid anhydride include maleic anhydride, citraconic anhydride, itaconic anhydride and alkenylsuccinic anhydride.

Examples of the unsaturated dibasic acid monoesters include maleic acid monomethyl ester, maleic acid monoethyl ester, maleic acid monobutyl ester, citraconic acid monomethyl esters, citraconic acid monoethyl esters, citraconic acid monobutyl esters, itaconic acid monomethyl esters, alkenylsuccinic acid monomethyl, fumaric acid monomethyl esters and mesaconic acid monomethyl esters.

Examples of the unsaturated dibasic acid esters include dimethyl maleate and dimethyl fumarate.

Examples of the α,β-unsaturated acids include crotonic acid and cinnamic acid.

Examples of the α,β-unsaturated acid anhydride include crotonic anhydride and cinnamic anhydride.

Examples of the carboxyl group-containing monomers include acid anhydrides formed between the α,β-unsaturated acids and lower fatty acids; and alkenylmalonic acid, alkenylglutaric acid and alkenyladipic acid, acid anhydrides or monoesters thereof.

Examples of the (meth)acrylic acid hydroxyalkyl esters include 2-hydroxyethyl acrylate, 2-hydroxyethyl methacrylate and 2-hydroxypropyl methacrylate.

Examples of the hydroxy group-containing monomers include 4-(1-hydroxy-1-methylbutyl)styrene and 4-(1-hydroxy-1-methylhexyl)styrene.

Among them, styrene, acrylic acid, n-butyl acrylate, 2-ethylhexyl acrylate, methacrylic acid, n-butyl methacrylate and 2-ethylhexyl methacrylate are more preferable. When they are used in combination with at least styrene and acrylic acid, dispersibility of a release agent is remarkably excellent, which is particularly preferred.

If necessary, a crosslinking agent for the addition polymerization monomer may be further added.

Examples of the crosslinking agent include aromatic divinyl compounds, diacrylate compounds having an alkyl chain as a linking moiety, diacrylate compounds having, as a linking moiety, an alkyl chain containing an ether bond, and polyester diacrylates.

Examples of the aromatic divinyl compounds include divinyl benzene and divinyl naphthalene.

Examples of the diacrylate compounds having an alkyl chain as a linking moiety include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and methacrylate compounds where the acrylates of the above-listed compounds are changed to methacrylates.

Examples of the diacrylate compounds having, as a linking moiety, an alkyl chain containing an ether bond include: diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and methacrylate compounds where the acrylates of the above-listed compounds are changed to methacrylates.

Further examples include di(meth)acrylate compounds having, as a linking moiety, a chain containing an aromatic group and an ether bond.

Examples of the polyester diacrylates include MANDA (trade name) (manufactured by NIPPON KAYAKU CO., LTD.).

Examples of multifunctional crosslinking agents include pentaerythritol triacrylate, trimethylolethane triacrylate, trimethylolpropane triacrylate, tetramethylolmethane tetraacrylate, oligoester acrylate, methacrylate compounds where the acrylates of the above-listed compounds are changed to methacrylates, triallyl cyanurate and triallyl trimellitate.

The crosslinking agent is added in an amount of preferably 0.01 parts by mass to 10 parts by mass, more preferably 0.03 parts by mass to 5 parts by mass, relative to 100 parts by mass of the addition polymerization monomer used.

A polymerization initiator used in polymerizing the addition polymerization monomer is not particularly limited and may be appropriately selected depending on the intended purpose. Examples thereof include azo polymerization initiators and peroxide polymerization initiators.

Examples of the azo polymerization initiators include 2,2'-azobisisobutylonitrile, 2,2'-azobis(4-methoxy-2,4-dimethylvaleronitrile) and 2,2'-azobis(2,4-dimethylvaleronitrile).

Examples of the peroxide polymerization initiators include methyl ethyl ketone peroxide, acetylacetone peroxide, 2,2-bis(tert-butylperoxy)butane, tert-butyl hydroperoxide, benzoyl peroxide and n-butyl-4,4-di-(tert-butylperoxy) valerate.

These may be used in combination for the purpose of adjusting the resin in terms of molecular weight and molecular weight distribution.

The polymerization initiator is added in an amount of preferably 0.01 parts by mass to 15 parts by mass, more preferably 0.1 parts by mass to 10 parts by mass, relative to 100 parts by mass of the addition polymerization monomer used.

In order to chemically binding the condensation polymerization unit with the addition polymerization unit, for example, a monomer reactive in both condensation polymerization and addition polymerization (i.e., a condensation-addition polymerization-reactive monomer) is used.

Examples of the condensation-addition polymerization-reactive monomer include unsaturated carboxylic acids such as acrylic acid and methacrylic acid, unsaturated dicarboxylic acids such as fumaric acid, maleic acid, citraconic acid and itaconic acid, or anhydrides thereof, and vinyl monomers containing a hydroxyl group.

The condensation-addition polymerization-reactive monomer is added in an amount of preferably 1 part by mass to 25 parts by mass, more preferably 2 parts by mass to 20 parts by mass, relative to 100 parts by mass of the addition polymerization monomer used.

When the composite resin (C) is produced in one reaction vessel, both the condensation polymerization reaction and the addition polymerization reaction are allowed to proceed and/or complete at the same time. Alternatively, both the reactions may be completed independently by selecting the reaction temperature and time for each of the reactions.

In one exemplary method, a mixture of the addition polymerization monomer and the polymerization initiator is added dropwise to a mixture of the condensation polymerization monomer in a reaction vessel, followed by mixing in advance. After that, the addition polymerization is first completed through radical polymerization reaction, and then the condensation polymerization is allowed to proceed by raising the reaction temperature.

In this manner, when two independent reactions are allowed to proceed in the reaction vessel, two different kinds of resin units can be effectively dispersed or bound together.

The composite resin (C) is preferably a composite resin containing a polyester resin unit as the condensation polymerization unit and a vinyl resin as the addition polymerization unit, which allows the composite resin (C) to exhibit its function more effectively.

The softening temperature (T½) of the composite resin (C) is preferably 90° C. to 130° C., more preferably 100° C. to 120° C.

When the softening temperature (T½) thereof is lower than 90° C., there may be degradation in heat resistance storage stability and hot offset resistance. When it is higher than 130° C., there may be degradation in low-temperature fixing property.

Also, the glass transition temperature of the composite resin (C) is preferably 45° C. to 80° C., more preferably 50° C. to 70° C., particularly preferably 53° C. to 65° C. from the viewpoints of fixing property, storage stability and durability.

The acid value of the composite resin (C) is preferably 5 mgKOH/g to 80 mgKOH/g, more preferably 15 mgKOH/g to 40 mgKOH/g, from the viewpoints of charging property and environmental stability.

An amount of the resin (A) contained in the toner is preferably 20% by mass to 80% by mass, an amount of the resin (B) contained in the toner is preferably 80% by mass to 20% by mass, and an amount of the composite resin (C) contained in the toner is preferably 1% by mass to 10% by mass.

In the present invention, in order to achieve a toner having the desired main peak and half value width, a resin (B) having various main peaks and half value widths is used. For example, in the case of producing a toner having a main peak and a half value width in a high molecular weight region, a resin (B) having a main peak and a half value width in the high molecular weight region is preferably used.

<Calcium Carbonate>

An amount of the calcium carbonate contained in the toner is 5% by mass to 35% by mass.

The present inventors have been found that, when the calcium carbonate is contained in the toner, hot-offset resistance and heat resistance storage stability can be achieved due to internal aggregation force of the calcium carbonate.

When the amount of the calcium carbonate contained in the toner is less than 5% by mass, hot-offset resistance and heat resistance storage stability are degraded due to small aggregation force of the calcium carbonate. When the amount of the calcium carbonate contained in the toner is more than 35% by mass, low-temperature fixing property is degraded due to excessively large internal aggregation force.

The amount of the calcium carbonate contained in the toner is more preferably 10% by mass to 30% by mass.

A proportion of calcium carbonate existing on a surface of a toner can be confirmed by measuring contents of elements C, O, and Ca using EDS (energy dispersive X-ray spectrometry) and detecting the proportion of the Ca content relative to the total thereof. The Ca content may be preferably 1% by mass to 60% by mass, more preferably 5% by mass to 30% by mass when the contents of the elements C, O, and Ca is measured using EDS. When the Ca exists on the surface of the toner in the proportion falling within the above preferable range, both effects of adhesion of toner to each other and charging property contributing to the lower limit fixing temperature can be achieved, which is preferable.

The "surface of toner," as used herein, means a region from an outermost surface to about 1 μm deep of the toner. In the EDS measurement, Ca derived from calcium carbonate existing in the region from the outermost surface to about 1 μm deep of the toner is detected. Note that, the calcium carbonate may exist on the surface of the toner in any positional relationship with the toner, as long as the desired Ca content is given by the measurement with EDS. The calcium carbonate is preferably embedded in the toner, but any aspect in which a part of the calcium carbonate is protruded from the surface of the toner is also included.

The Ca content measured with EDS can be allowed to fall within the range defined in the present invention by selectively devising in terms of formulation and a step as follows.

—Formulation—For example, the particle diameter of the calcium carbonate is set to 0.1 μm to 10 μm, which prevents the calcium carbonate from protruding from the surface of the toner.

For example, a preferable resin (e.g., polyester) is used, resulting in an improved binding property of the resin to the calcium carbonate because the polyester is likely to bind to the calcium carbonate in terms of polarity.

For example, inclusion of wax improves wettability. The dispersibility in and the wettability on the resin are improved by containing the wax in the percentage of 1% by mass to 10% by mass (preferably 2% by mass to 5% by mass) in combination with the calcium carbonate.

For example, fine powder (i.e., powder having a particle diameter of about 3 μm or less and produced during manufacture of the toner) is contained in the percentage of 0% by mass to 30% by mass. The fine powder improves the dispersibility in and the wettability on the resin by covering the calcium carbonate due to its higher specific surface area than other particles.

—Step—

For example, the calcium carbonate is subjected to surface treatment, which improves the dispersibility in and the wettability on the resin.

Aminosilane, titanate silane, or fatty acids are used, which allows surface tension of the calcium carbonate to approach critical surface tension of the resin to thereby improve the dispersibility in and the wettability.

For example, particle size distribution of the calcium carbonate is adjusted in advance, which prevents the calcium carbonate from aggregating due to its dispersion failure.

For example, the calcium carbonate is crushed in advance, which prevents initial aggregation thereof.

The initial aggregation is prevented by crushing the calcium carbonate in advance. It also prevents aggregates from having fracture surfaces during pulverization.

For example, the wettability is improved by kneading at a high temperature (e.g., 120° C. to 180° C., preferably 120° C. to 150° C.), which softens the resin and improves the wettability of the calcium carbonate on the resin (anchor effect).

For example, the calcium carbonate is embedded in the toner by melting the toner with METEORAINBOW. That is, the resin component of the toner is melted under a high temperature to thereby enclose the calcium carbonate protruding from the surface of the toner.

For example, the calcium carbonate is embedded by allowing the resin to collide with the toner through hybridization.

The resin is collided with the surface of the toner by mixing with the toner to thereby embed the calcium carbonate.

A beneficial effect and an adverse effect of the binder resin are greatly contributed by an amount of the calcium carbonate existing on the surface of the toner. Therefore, by adjusting the amount of the calcium carbonate relative to that of the binder resin and the degree of dispersion of the calcium carbonate, and optimizing the proportion of the calcium carbonate existing on the surface of the toner, heat resistance storage stability can be kept very excellent while ensuring low-temperature fixing property.

In the present invention, a toner excellent in all of low-temperature fixing property, heat resistance storage stability, and hot-offset resistance can be provided by considering a balance among the resin (A), the resin (B), the composite resin (C), and the calcium carbonate, utilizing characteristics thereof, adjusting the amount and the degree of dispersion thereof, and defining the above requirements.

The contents of elements C, O, and Ca are measured with EDS as follows.

[Measurement of Ca Content with EDS]

OPC80AJ (manufactured by Filgen, Inc.) is used as a coating device and MWRIN (manufactured by Carl Zeiss AG) is used as a measurement device.

Various parameters are set as follows:

Accelerating voltage: 10 kV (Voltage for Accelerating Detecting Electrons in Irradiation Device)

Operating distance: 14.05 mm (Distance from Irradiation Device to Sample)

Live time limit: 100 sec (Measurement Time. The Longer it is, the Higher Detection Precision is.)

Time constant: 30

(Detection Time. It Affects Detection Sensitivity of EDS.)

Dead time: 20 to 30

(Proportion of Time for which Detection is not Performed Relative to Overall Incidence Time.)

Irradiation current: 170 pA (Current Applied Upon Releasing Electrons from Electrode)

Resolution (mapping): 256×192

Frame time (mapping): the fastest

Frame number (mapping): 10,000 or more

Resolution (image tab): 512×384

Frame time (image tab): 5.0

Frame number (image tab): 1

The measurement is performed as follows:

1) A toner (about 10 mg) is adhered to a piece of a carbon tape.

2) The toner on the tape is subjected to a Os coating in a chamber.

3) Various parameters are set.

4) Measurement is performed (Contents of elements, i.e., C, O, and Ca are measured and the proportion (in % by mass) of the Ca content relative to the total thereof is detected.).

5) The above measurement is repeated 10 times and an average value of the resulting values is determined as the Ca content (% by mass).

A particle diameter of the calcium carbonate is preferably 0.1 μm to 10 μm because the calcium carbonate having an excessively large particle diameter cannot be added to toner particles, while the calcium carbonate having an excessively small particle diameter is likely to form aggregates.

<Colorant>

The colorant is not particularly limited and may be appropriately selected depending on the intended purpose. Examples thereof include dyes and pigments such as carbon black, lamp black, iron black, aniline blue, phthalocyanine blue, phthalocyanine green, Hansa yellow G, rhodamine 6C lake, Calco Oil Blue, chrome yellow, quinacridone, Benzidine Yellow, rose Bengal and triallylmethane dyes. These may be used alone or in combination. The toner of the present invention can be used as a black toner or a full color toner by using the colorant.

Among them, carbon black has a particularly excellent black-coloring ability.

An amount of the colorant is preferably 1% by mass to 30% by mass, more preferably 3% by mass to 20% by mass relative to that of the toner resin components.

<Release Agent>

The release agent is not particularly limited and may be appropriately selected from conventionally known ones depending on the intended purpose. Examples thereof include low molecular weight polyolefin wax, synthetic hydrocarbon wax, natural wax, petroleum wax; higher fatty acids and metal salts and amides thereof synthetic ester wax, and various modified wax thereof.

Examples of the low molecular weight polyolefin wax include low molecular weight polyethylenes and low molecular weight polypropylenes.

Examples of the synthetic hydrocarbon wax include Fischer-Tropsch wax.

Examples of the natural wax include beeswax, carnauba wax, candelilla wax, rice wax and montan wax.

Examples of the petroleum wax include paraffin wax and microcrystalline wax.

Examples of the higher fatty acids include stearic acid, palmitic acid and myristic acid.

Among them, carnauba wax and a modified wax thereof, polyethylene wax, and synthetic ester wax are suitably used. Carnauba wax is particularly preferred since it is properly finely dispersed in a polyester resin or a polyol resin, to make it easy to form a toner excellent in all of hot offset resistance, transferability and durability.

These release agents may be used alone or in combination.

An amount of the release agent is preferably 2% by mass to 15% by mass relative to that of the toner. When the amount thereof is less than 2% by mass, a hot offset-preventing effect is insufficient. When it is more than 15% by mass, the transferability and the durability are degraded.

The melting point of the release agent is preferably 70° C. to 150° C. When the melting point is lower than 70° C., the toner may be degraded in heat resistance storage stability. When it is higher than 150° C., the release agent cannot sufficiently exhibit its releasing property in some cases.

<Other Ingredients>

<<Charge Controlling Agent>>

A charge controlling agent is not particularly limited and may be appropriately selected from known ones depending on the intended purpose. Examples thereof include Nigrosine dyes, triphenylmethane dyes, chromium-containing metal complex dyes, molybdic acid chelate pigments, Rhodamine dyes, alkoxyamines, quaternary ammonium salts (including fluorine-modified quaternary ammonium salts), alkylamides, phosphor or phosphor-containing compounds, tungsten or tungsten-containing compounds, fluorine-containing activators, salicylic acid metal salts, salicylic acid derivative metal salts, and calixarene. Specific examples thereof include BONTRON 03 (Nigrosine dyes), BONTRON P-51 (quaternary ammonium salt), BONTRON S-34 (metal-containing azo dye), E-82 (oxynaphthoic acid metal complex), E-84, E-108, and E-304 (salicylic acid metal complex), which are manufactured by Orient Chemical Industries Co., Ltd.; TP-302 (molybdenum complex of quaternary ammonium salt), TP-415, and TN-105 (aqua 3,5-bis(1,1-dimethylethyl)-2-hydroxybenzoate hydroxy oxo zirconium complexes (raw material), salicylic acid derivative of zirconium compound), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymeric compounds having a functional group such as a sulfonate group, a carboxyl group, and a quaternary ammonium group.

<Production Method of Toner>

The toner of the present invention is produced through a pulverization method. Note that, well-known and conventionally used pulverization methods may be used. The toner is preferably a pulverized toner produced through a so-called pulverization method including a melt-kneading step.

The pulverization method is a method where toner materials including at least the resin (A), the resin (B), the composite resin (C), and the calcium carbonate, and, if necessary, further including the colorant, the release agent, and other materials such as the charge-controlling agent are mixed together in a dry process; and the resultant mixture is melt-kneaded using a kneader and pulverized to thereby obtain a pulverized toner.

In a melt-kneading step, the toner materials are mixed together and the resultant mixture is melt-kneaded using a melt-kneader. Examples of the melt-kneader include uniaxial or biaxial continuous kneaders and batch kneaders using a roll mill. Specific examples thereof include a KTK-type biaxial extruder (manufactured by KOBE STEEL, Ltd.), a TEM-type extruder (manufactured by TOSHIBA MACHINE CO., LTD.), a biaxial extruder (manufactured by KCK Co., Ltd.), a PCM-type biaxial extruder (manufactured by IKEGAI LTD.) and a co-kneader (manufactured by BUSS Company).

Preferably, the melt-kneading is performed under appropriate conditions so as not to cleave the molecular chains of the binder resin. The temperature during the melt-kneading is determined in consideration of the softening point of the binder resin. Specifically, when the temperature is excessively higher than the softening point, cleavage of the molecular chains occurs to a considerable extent; whereas when the temperature is excessively lower than the softening point, a sufficient dispersion state is difficult to attain.

In a pulverizing step, a kneaded product obtained in the melt-kneading step is pulverized. In this pulverization, the kneaded product is preferably roughly pulverized and then finely pulverized. Examples of pulverizing manner preferably used include a manner in which the kneaded product is crushed against a collision plate under a jet stream for pulverization, a manner in which the kneaded particles are crushed one another under a jet stream for pulverization, and a manner in which the kneaded product is pulverized by passing through the narrow gap between a mechanically rotating rotor and a stator.

In a classification step, the pulverized product obtained in the pulverization step is classified to prepare particles having a predetermined particle diameter. This classification is performed by removing microparticles using, for example, a cyclone, a decanter or a centrifugal separator.

After completion of the pulverization and classification, the pulverized product is classified in a gas flow by the action of centrifugal force to thereby produce toner particles (toner base particles) having a predetermined particle diameter.

(Image Forming Apparatus and Image Forming Method)

An image forming apparatus of the present invention includes an electrostatic latent image bearer, an electrostatic latent image forming unit, and a developing unit; and, if necessary, further includes other units.

An image forming method of the present invention includes an electrostatic latent image forming step, and a developing step; and, if necessary, further includes other steps.

The image forming method can suitably be performed by the image forming apparatus. The electrostatic latent image forming step can suitably be performed by the electrostatic latent image forming unit. The developing step can suitably be performed by the developing unit. The other steps can suitably be performed by the other units.

<Electrostatic Latent Image Bearer>

The electrostatic latent image bearer is not particularly limited in terms of the material, structure, and size thereof, and may be appropriately selected from those known in the art. Examples of the materials thereof include inorganic photoconductors such as amorphous silicons and seleniums; and organic photoconductors such as polysilanes and phthalo polymethines. Among these materials, amorphous silicons are preferred in terms of longer operating life.

The amorphous silicon photoconductor may be, for example, a photoconductor having a support and a photoconductive layer of a-Si, which is formed on the support heated to 50° C. to 400° C. with a film formation method such as vacuum vapor deposition, sputtering, ion plating, thermal CVD (Chemical Vapor Deposition), photo-CVD or plasma CVD. Among them, the plasma CVD is suitably employed, in which gaseous raw materials are decomposed through application of direct current or high-frequency or microwave glow discharge to thereby form an a-Si deposition film on the support.

The shape of the electrostatic latent image bearer is not particularly limited and may be appropriately selected depending on the intended purpose, but is preferably a cylindrical shape. An external diameter of the electrostatic latent image bearer having the cylindrical shape is not particularly limited and may be appropriately selected depending on the intended purpose, but is preferably 3 mm to 100 mm, more preferably 5 mm to 50 mm, particularly preferably 10 mm to 30 mm.

<Electrostatic Latent Image Forming Unit and Electrostatic Latent Image Forming Step>

The electrostatic latent image forming unit is not particularly limited and may be appropriately selected depending on the intended purpose, as long as it is a unit configured to form an electrostatic latent image on the electrostatic latent image bearer. Example thereof includes one including at least a charging member configured to charge the surface of the electrostatic latent image bearer, and an exposing member configured to imagewise expose to light the surface of the electrostatic latent image bearer.

The electrostatic latent image forming step is not particularly limited and may be appropriately selected depending on the intended purpose, as long as it is a step of forming an electrostatic latent image on the electrostatic latent image bearer. For example, the electrostatic latent image forming step may be performed using the electrostatic latent image forming unit as follows. A surface of the electrostatic latent image bearer is charged and then imagewise exposed to light.

<<Charging Member and Charging>>

The charging member is not particularly limited and this may be selected appropriately depending on the purpose. Examples thereof include contact type chargers known in the art equipped with a conductive or semi-conductive roller, a brush, a film, or a rubber blade, and noncontact-type chargers which utilize corona discharge such as corotron and scorotron.

The charging can be performed by applying electric voltage to the surface of the electrostatic latent image bearer using the charging member.

The charging member may have any shape such as a charging roller as well as a magnetic brush and a fur brush. The shape thereof may be selected according to the specification or configuration of the image forming apparatus.

The charging member is not limited to the aforementioned contact-type charging members. However, the contact-type charging members are preferably used from the viewpoint of producing an image forming apparatus in which the amount of ozone generated from the charging member is reduced.

<<Exposing Member and Exposure>>

The exposing member is not particularly limited and may be appropriately selected depending on the intended purpose, as long as the surface of the electrostatic latent image bearer charged by the charging member can be imagewise exposed to light. Examples thereof include various types of exposing members such as photocopy optical systems, rod lens array systems, laser optical systems, and liquid-crystal shutter optical systems.

A light source used for the exposing member is not particularly limited and may be appropriately selected depending on the intended purpose. Examples thereof include common light-emitting devices such as a fluorescent lamp, a tungsten lamp, a halogen lamp, a mercury lamp, a sodium lamp, a light-emitting diode (LED), a laser diode (LD) and an electroluminescence (EL).

Also, various filters such as sharp-cut filter, a band-pass filter, an infrared cut filter, a dichroic filter, an interference filter and a color conversion filter may be used for emitting only light having a desired wavelength.

The exposure can be performed by imagewise exposing to light the surface of the electrostatic latent image bearer using the exposing member.

Note that, in the present invention, a back-exposure system may be employed, in which the electrostatic latent image bearer is imagewise exposed to light from the back side thereof.

<Developing Unit and Developing Step>

The developing unit is not particularly limited and may be appropriately selected depending on the intended purpose, as long as it is a developing unit with toner configured to develop the electrostatic latent image formed on the electrostatic latent image bearer to thereby form a toner image (visible image).

The developing step is not particularly limited and may be appropriately selected depending on the intended purpose, as long as it is a step of developing with toner the electrostatic latent image formed on the electrostatic latent image bearer to thereby form a toner image (visible image). The developing step can be performed using, for example, the developing unit.

The developing unit may be a dry-type developing unit or a wet-type developing unit, a single-color developing unit or a multi-color developing unit.

The developing unit is preferably a developing device which includes a stirrer for frictionally stirring and charging the toner; and a developer bearer which internally includes a fixed magnetic field generating unit and which is rotatable while bearing on the surface thereof a developer containing the toner.

<<Developer>>

A developer of the present invention includes the toner; and, if necessary, further include appropriately selected other ingredients such as carrier.

Therefore, the developer is excellent in transferability and charging property, and can stably form high-quality images. Note that, the developer may be a one-component developer or a two-component developer. However, when the toner is used in a high-speed printer developed in response to recent faster information processing speeds, the two-component developer is preferable from the viewpoint of longer operating life.

In the case of using the developer as the one-component developer, the particle diameter of the toner particles does not so much fluctuate through toner supply and consumption, and favorable and stable developing performance and image can be obtained even against a long time of stirring in the developing device, because there would occur little filming of the toner to the developing roller or melt-adhesion of the toner to a member such as a blade for thinning the toner into a thin layer.

In the case of using the developer as the two-component developer, the particle diameter of the toner particles does not so much fluctuate through toner supply and consumption for a long time, and favorable and stable developing performance and image can be obtained even against a long time of stirring in the developing unit.

<<<Carrier>>>

The carrier is not particularly limited, and may be appropriately selected depending on the intended purpose. However, the carrier has preferably a core and a resin layer covering the core.

—Core—

The core is not particularly limited in terms of the material thereof, and may be appropriately selected depending on the intended purpose. Examples thereof include a manganese-strontium based material with 50 emu/g to 90 emu/g and manganese-magnesium based material with 50 emu/g to 90 emu/g. In terms of securing the image density, highly magnetized materials such as iron powder (100 emu/g or more) and magnetite (75 emu/g to 120 emu/g) are preferably used. In terms of being advantageous in attaining high quality image by weakening the collision of the developer in a chain-like form against a photoconductor, weakly magnetized materials such as copper-zinc based material (30 emu/g to 80 emu/g) are preferably used.

These may be used alone or in combination.

A volume average particle diameter of the core is not particularly limited, and may be appropriately selected depending on the intended purpose, but is preferably 10 μm to 150 μm, more preferably 40 μm to 100 μm. When the volume average particle diameter is less than 10 μm, there may be more fine powder in the distribution of carrier particles, thus lowering magnetization per particle and often causing carrier scattering. When the volume average particle diameter exceeds 150 μm, the specific surface area of the carrier is decreased, potentially leading to toner scattering and poor reproducibility especially in solid parts in full color printing with more solid parts.

In the case of using the toner in the two-component developer, the toner may be mixed with the carrier. An amount of the carrier contained in the two-component developer is not particularly limited and may be appropriately selected depending on the intended purpose, but is preferably 90 parts by mass to 98 parts by mass, more preferably 93 parts by mass to 97 parts by mass relative to 100 parts by mass of the two-component developer.

The developer of the present invention can suitably used for image formation with various known electrophotographic method such as a magnetic one-component developing method, a non-magnetic one-component developing method, and a two-component developing method.

Inside the developing unit, for example, the toner and the carrier are mixed and agitated together, during which the toner is charged by friction upon mixing and is retained on the surface of a rotating magnet roller in a chain-like form to thereby form a magnetic brush. Since the magnet roller is arranged in the vicinity of the electrostatic latent image bearer, the toner constituting the magnetic brush formed on the surface of the magnet roller is partially moved to the surface of the electrostatic latent image bearer due to an electrical suction force. As a result, the electrostatic latent image is developed with the toner and a visible image is formed on the surface of the electrostatic latent image bearer with the toner.

<Other Units and Other Steps>

Examples of the other units include a transfer unit, a fixing unit, a cleaning unit, a charge eliminating unit, a recycle unit, and a control unit.

Examples of the other steps include a transfer step, a fixing step, a cleaning step, a charge eliminating step, a recycle step, and a control step.

<<Transfer Unit and Transfer Step>>

The transfer unit is not particularly limited and may be appropriately selected depending on the intended purpose, as long as it is a unit configured to transfer a visible image onto a recording medium. The transfer unit preferably includes a primary transfer unit configured to transfer a visible image onto an intermediate transfer member to thereby form a composite transfer image, and a secondary transfer unit configured to transfer the composite transfer image onto the recording medium.

The transfer step is not particularly limited and may be appropriately selected depending on the intended purpose, as long as it is a step of transferring a visible image onto a recording medium. A preferable aspect is that, by using an intermediate transfer member, a visible image is primarily transferred onto the intermediate transfer member and then the visible image is secondarily transferred onto the recording medium.

The transfer step can be performed by transferring the visible image through charging the photoconductor using a transfer charger, and can be performed using the transfer unit.

Herein, when an image to be secondarily transferred onto the recording medium is a color image of several color toners, the transfer may be performed as follows. The transfer unit superposes the color toners on top of another on the intermediate transfer member to thereby form an image on the intermediate transfer member, and then, the image formed on the intermediate transfer member is secondarily transferred at once onto the recording member using the intermediate transfer unit.

Note that, the intermediate transfer member is not particularly limited and may be selected appropriately from those known in the art depending on the intended purpose. Suitable examples thereof include a transfer belt.

The transfer units (the primary transfer unit and the secondary transfer unit) preferably includes at least a transfer device configured to separate and then charge the visible image formed on the photoconductor, onto the recording medium. Examples of the transfer device include a corona transfer device with corona discharge, a transfer belt, a transfer roller, a pressure transfer roller, and an adhesive transfer device.

Note that, the recording medium is typically plane paper, but it is not particularly limited and may be appropriately selected depending on the intended purpose, as long as it can transfer an unfixed image after developing. PET bases for OHP can also be used as the recording medium.

<<Fixing Unit and Fixing Step>>

The fixing unit is not particularly limited and may be appropriately selected depending on the intended purpose, as long as it is a unit configured to fix a transfer image transferred onto a recording medium. However, a heat pressure member known in the art is preferable. Examples of the heat pressure member include a combination of a heating roller and a pressure roller, and a combination of a heating roller, a pressure roller, and an endless belt.

The fixing step is not particularly limited and may be appropriately selected depending on the intended purpose, as long as it is a step of fixing a visible image transferred onto a recording medium. The fixing step may be performed every after a toner image of each color is transferred onto the recording medium; or may be performed at one time after toner images of all colors are superposed on top of one another on the recording medium.

The fixing step can be performed using the fixing unit.

The heating temperature in the heat pressure member is preferably 80° C. to 200° C.

Note that, in the present invention, a known photo-fixing device may be used in addition to or instead of the fixing unit depending on the purpose.

A surface pressure at the fixing step is not particularly limited and may be appropriately selected depending on the intended purpose, but is preferably 10 $N/cm^2$ to 80 $N/cm^2$.

<<Cleaning Unit and Cleaning Step>>

The cleaning unit is not particularly limited and may be appropriately selected depending on the intended purpose, as long as it is a unit configured to remove the toner remaining on the photoconductor. Examples thereof include a magnetic brush cleaner, an electrostatic brush cleaner, a magnetic roller cleaner, a blade cleaner, a brush cleaner, and a wave cleaner.

The cleaning step is not particularly limited and may be appropriately selected depending on the intended purpose, as long as it is a step of removing the toner remaining on the photoconductor. The cleaning step can be performed using the cleaning unit.

<<Charge Eliminating Unit and Charge Eliminating Step>>

The charge eliminating unit is not particularly limited and may be appropriately selected depending on the intended purpose, as long as it is a unit configured to charge eliminate the photoconductor by applying a charge eliminating bias thereto. Example thereof includes a charge eliminating lamp.

The charge eliminating step is not particularly limited and may be appropriately selected depending on the intended purpose, as long as it is a step of charge eliminating the photoconductor by applying a charge eliminating bias thereto. This step can be performed using a charge eliminating unit.

<<Recycle Unit and Recycle Step>>

The recycle unit is not particularly limited and may be appropriately selected depending on the intended purpose, as long as it is a unit configured to recycle the toner, which has been removed in the cleaning step, to the developing device. Example thereof includes known conveying units.

The recycle step is not particularly limited and may be appropriately selected depending on the intended purpose, as long as it is a step of recycling the toner, which has been removed in the cleaning process, to the developing unit. The recycle step can be performed using the recycle unit.

<<Control Unit and Control Step>>

The control unit is not particularly limited and may be appropriately selected depending on the intended purpose, as long as it is a unit configured to be capable of controlling the operations of the respective units. Example thereof includes equipment such as sequencers and computers.

The control step is not particularly limited and may be appropriately selected depending on the intended purpose, as long as it is a step of capable being of controlling the operations in the respective steps. The control step can be performed using the control unit.

With reference to FIG. 1, next will be described one exemplary image forming method employing the image forming apparatus of the present invention. A color image forming apparatus 100A shown in FIG. 1 includes a photoconductor drum 10 (hereinafter may be referred to as "photoconductor 10") serving as the electrostatic latent image bearer, a charging roller 20 serving as the charging unit, an exposing device 30 serving as the exposing unit, a developing device 40 serving as the developing unit, an intermediate transfer member 50, a cleaning device 60 having a cleaning blade serving as the cleaning unit, and a charge-eliminating lamp 70 serving as the charge-eliminating unit.

The intermediate transfer member 50 is an endless belt and is designed to be driven in a direction indicated by an arrow with three rollers 51 which are provided in a loop of the belt for supporting the belt. Some of three rollers 51 serve also as a transfer bias roller capable of applying a predetermined transfer bias (primary transfer bias) to the intermediate transfer member 50. A cleaning device 90 having a cleaning blade is disposed in the vicinity of the intermediate transfer member 50. Also in the vicinity of the intermediate transfer member 50, a transfer roller 80 is disposed so as to face the intermediate transfer member 50 and serves as the transfer unit capable of applying a transfer bias for transferring (secondarily transferring) a developed image (toner image) onto a transfer paper 95 (serving as a recording medium). Around the intermediate transfer member 50, a corona charger 58 configured to apply charges to the toner image on the intermediate transfer member 50 is disposed, in the rotation direction of the intermediate transfer member 50, between a contact portion of the photoconductor 10 with the intermediate transfer member 50 and a contact portion of the intermediate transfer member 50 with the transfer paper 95.

The developing device 40 includes a developing belt 41 serving as the developer-carrier; and a black developing unit 45K, a yellow developing unit 45Y, a magenta developing unit 45M and a cyan developing unit 45C, these units being arranged in a row around the developing belt 41. Note that, the black developing unit 45K includes a developer housing section 42K, a developer supplying roller 43K, and a developing roller 44K. The yellow developing unit 45Y includes a developer housing section 42Y, a developer supplying roller 43Y, and a developing roller 44Y. The magenta developing unit 45M includes a developer housing section 42M, a developer supplying roller 43M, and a developing roller 44M. The cyan developing unit 45C includes a developer housing section 42C, a developer supplying roller 43C, and a developing roller 44C. The developing belt 41 is an endless belt and is rotatably supported by a plurality of belt rollers, some of which are in contact with the electrostatic latent image bearer 10.

In the color image forming apparatus 100 shown in FIG. 1, for example, the charging roller 20 uniformly charges the photoconductor drum 10. The photoconductor drum 10 is imagewise exposed to light by the exposing device 30 to form an electrostatic latent image. The electrostatic latent image formed on the photoconductor drum 10 is developed with a toner supplied from the developing device 40 to form a toner image. The toner image is transferred onto the intermediate transfer member 50 (primary transfer) with a voltage applied from the rollers 51. The thus-transferred image is transferred onto the recording paper 95 (secondary transfer). As a result, a transfer image is formed on the transfer paper 95. Note that, toner particles remaining on the photoconductor 10 are removed by the cleaning device 60, and charges on the photoconductor 10 are removed by the charge-eliminating lamp 70.

Figure 2:
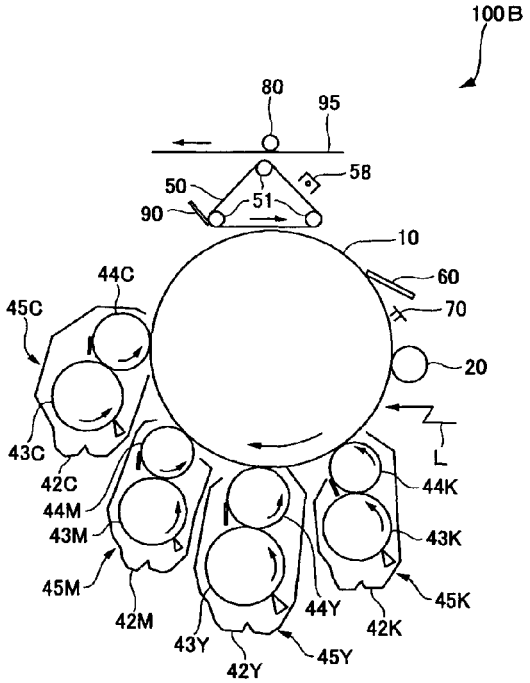
FIG. 2 is a schematic, structural view of another exemplary image forming apparatus of the present invention.

FIG. 2 illustrates another exemplary image forming apparatus of the present invention. An image forming apparatus 100B has the same configuration as the image forming apparatus 100A shown in FIG. 1, except that it does not include the developing belt 41, but the black developing unit 45K, the yellow developing unit 45Y, the magenta developing unit 45M, and the cyan developing unit 45C are provided around the photoconductor 10 so as to be directly opposite to the photoconductor.

Figure 3:
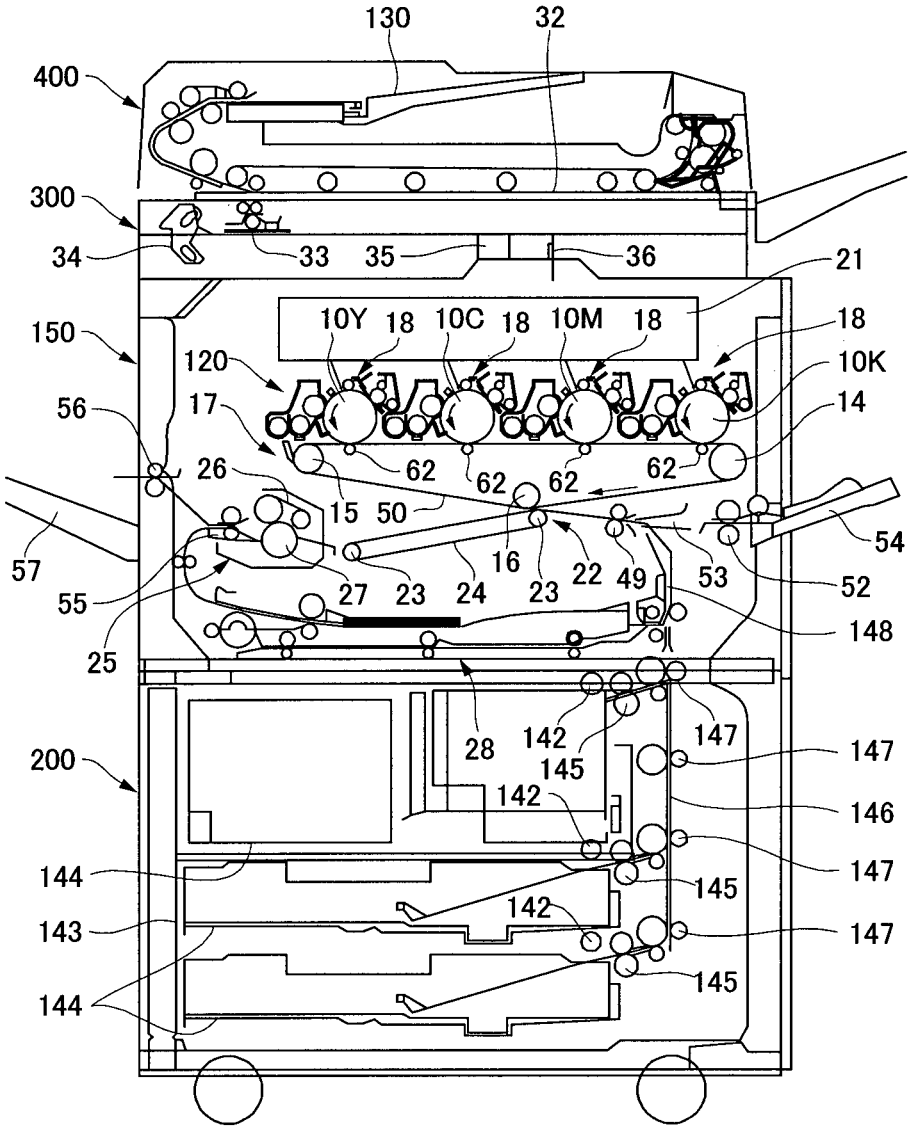
FIG. 3 is a schematic, structural view of another exemplary image forming apparatus of the present invention.

FIG. 3 illustrates another exemplary image forming apparatus of the present invention. A image forming apparatus shown in FIG. 2 includes a copying device main body 150, a paper feeding table 200, a scanner 300 and an automatic document feeder (ADF) 400.

The copying device main body 150 is provided at its center portion with an endless belt-shaped intermediate transfer member 50. The intermediate transfer member 50 is tightly stretched by supporting rollers 14, 15 and 16 and can be clockwise rotated in FIG. 3. A cleaning device 17 for removing toner particles remaining on the intermediate transfer member 50 is disposed in the vicinity of the supporting roller 15. Around the intermediate transfer member 50 tightly stretched by supporting rollers 14 and 15 is provided a tandem developing device 120 so as to be opposite to four image forming units 18 for yellow toner, cyan toner, magenta toner and black toner which are arranged in a row along a conveying direction of the intermediate transfer member. An exposing device 21 serving as the exposing member is provided in the vicinity of the tandem developing device 120. A secondary transfer device 22 is provided on the intermediate transfer member 50 on the side opposite to the side where the tandem developing device 120 is disposed. The secondary transfer device 22 includes an endless belt-shaped secondary transfer belt 24 and a pair of supporting rollers 23 tightly stretching the belt. A transfer paper conveyed on the secondary transfer belt 24 can come into contact with the intermediate transfer member 50. A fixing device 25 serving as the fixing unit is provided in the vicinity of the secondary transfer device 22. The fixing device 25 includes an endless fixing belt 26 and a press roller 27 provided so as to be pressed against the fixing belt.

Note that, in the tandem image forming apparatus, a sheet reversing device 28 for reversing the transfer paper when image formation is performed on both sides of the transfer paper is disposed in the vicinity of the secondary transfer device 22 and the fixing device 25.

Next will be described formation of a full color image (color copy) using the tandem developing device 120. Firstly, an original document is set on a document table 130 of the automatic document feeder (ADF) 400. Alternatively, the automatic document feeder 400 is opened and then an original document is set on a contact glass 32 of the scanner 300, followed by closing of the automatic document feeder 400.

In the case where an original document is set on the automatic document feeder (ADF) 400, when a starting switch (not illustrated) is pressed, the scanner 300 is operated after the original document has been conveyed onto the contact glass 32. In the case where the original document is set on a contact glass 32, the scanner is operated immediately after the starting switch is pressed. And then, a first carriage 33 and a second carriage 34 begin to run. At that time, the first carriage 33 irradiates the original document with light from a light source, and then the second carriage 34 reflects, on its mirror, light reflected by the original document. The thus-reflected light is received by a reading sensor 36 through an imaging forming lens 35, so that the color document (color image) is read, to thereby form image information corresponding to black, yellow, magenta and cyan.

Figure 4:
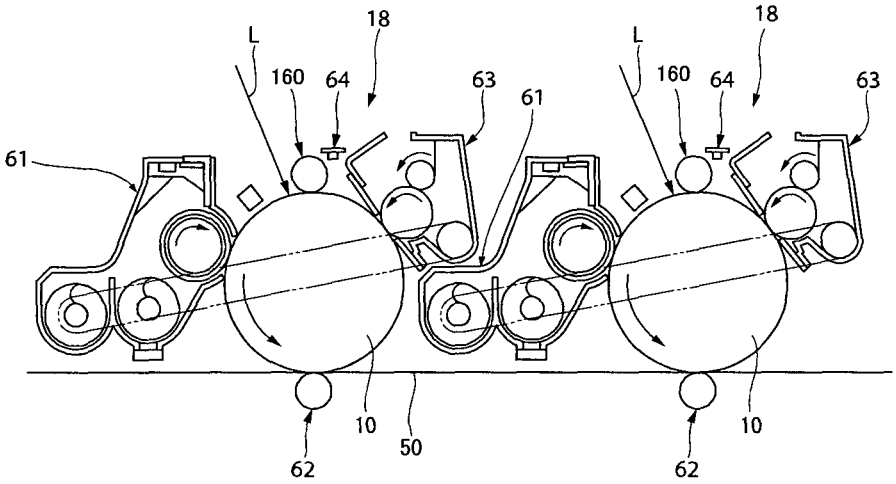
FIG. 4 is an enlarged view of a part of the image forming apparatus shown in FIG. 3.

The thus-formed image information corresponding to black, yellow, magenta and cyan is transmitted to a corresponding image forming unit 18 (black-, yellow-, magenta- or cyan-image forming unit) in the tandem developing device 120, and then toner images of black, yellow, magenta and cyan are formed with the image forming units. Specifically, as shown in FIG. 4, each of the image forming units 18 (black-, yellow-, magenta- and cyan-image forming units) in the tandem developing device 120 includes an electrostatic latent image bearer 10 (black electrostatic latent image bearer 10K, yellow electrostatic latent image bearer 10Y, magenta electrostatic latent image bearer 10M or cyan electrostatic latent image bearer 10C); a charging device 160 serving as the charging unit for uniformly charging the electrostatic latent image bearer 10; an exposing device for imagewise exposing the electrostatic latent image bearer to light (indicated by a symbol L in FIG. 4) based on image information corresponding to black, yellow, magenta and cyan to thereby form on the electrostatic latent image bearer an electrostatic latent image corresponding to each of black, yellow, magenta and cyan; a developing device 61 for developing the electrostatic latent image with each color toner (black toner, yellow toner, magenta toner and cyan toner) to form a color toner image; a transfer charger 62 for transferring the color toner image onto the intermediate transfer member 50; a cleaning device 63; and a charge-eliminating device 64. Thus, each image forming unit 18 can form each monochromatic image (black, yellow, magenta or cyan image) based on image information corresponding to each color. The thus-formed black, yellow, magenta and cyan images, i.e., a black image formed on the black electrostatic latent image bearer 10K, a yellow image formed on the yellow electrostatic latent image bearer 10Y, a magenta image formed on the magenta electrostatic latent image bearer 10M, and a cyan image formed on the cyan electrostatic latent image bearer 10C, are sequentially transferred (primarily transferred) onto the intermediate transfer member 50 driven by the supporting rollers 14, 15 and 16 so as to be rotated. Then, the black, yellow, magenta and cyan images are superposed on the intermediate transfer member 50 to thereby form a composite color image (transferred color image).

In the paper feeding table 200, one of paper feeding rollers 142 is selectively rotated to feed sheets (recording paper) from one of vertically stacked paper feeding cassettes 144 housed in a paper bank 143. The thus-fed sheets are separated one another by a separating roller 145. The thus-separated sheet is fed through a paper feeding path 146, then fed through a paper feeding path 148 in the copying device main body 150 by a conveyance roller 147, and stopped at a registration roller 49. Alternatively, paper feeding rollers 142 are rotated to feed sheets (recording paper) placed on a manual feed tray 54. The thus-fed sheets are separated one another by a separating roller 52. The thus-separated sheet is fed through a manual feed path 53 and then stopped at the registration roller 49 in the same manner. Note that, the registration roller 49 is generally connected to the ground in use. Alternatively, it may be used with a bias being applied for removing paper dust from the sheet. The resist roller 49 is rotated to feed a sheet (recording paper) to between the intermediate transfer member 50 and the secondary transfer device 22, so that the composite color image (transferred color image) formed on the intermediate transfer member 50 is transferred (secondarily transferred) by the secondary transfer device 22 onto the sheet (recording paper), whereby a color image is formed on the sheet (recording paper). Note that, toner particles remaining on the intermediate transfer member 50 after image transfer is removed by a cleaning device 17 for cleaning the intermediate transfer member.

The sheet (recording paper) on which the color image has been transferred and formed is fed by the secondary transfer device 22 to a fixing device 25. The fixing device 25 fixes the composite color image (transferred color image) onto the sheet (recording paper) through application of heat and pressure. Subsequently, the sheet (recording paper) is switched by a switching claw 55, ejected from an ejection roller 56 and then stacked on a paper ejection tray 57. Alternatively, the sheet is switched by the switching claw 55 and reversed by a sheet reversing device 28. The reversed sheet is directed again to the transfer position where an image is recorded on the back surface thereof. The sheet is ejected from the ejection roller 56 and then stacked on a paper ejection tray 57.

(Process Cartridge)

A process cartridge of the present invention is shaped so as to be attachable to and detachable from various image forming apparatus, and include an electrostatic latent image bearer configured to bear an electrostatic latent image and a developing unit configured to develop with a developer of the present invention the electrostatic latent image borne on the electrostatic latent image bearer to thereby form a toner image. Note that, the process cartridge of the present invention may further include other units, if necessary.

The developing unit includes a developer housing section configured to house the developer of the present invention and a developer carrier configured to carry and convey the developer housed in the developer housing section. Note that, the developing unit may further include a regulating member configured to regulate a thickness of the developer to be carried.

Figure 5:
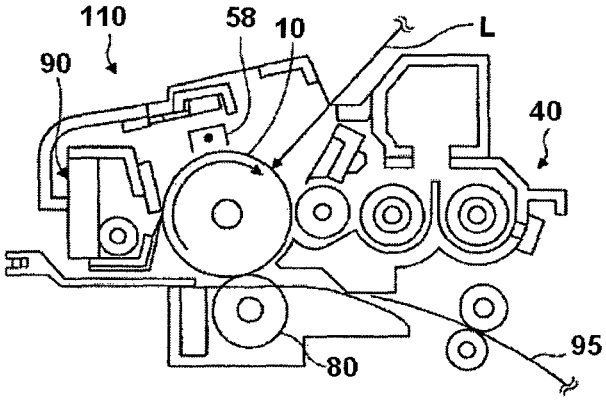
FIG. 5 is a schematic, structural view of one exemplary process cartridge of the present invention.

FIG. 5 illustrates one exemplary process cartridge of the present invention. A process cartridge 110 includes a photoconductor drum 10, a corona charger 58, a developing device 40, a transfer roller 80, and a cleaning device 90.

EXAMPLES

The present invention will now be described in more detail with reference to Examples and Comparative Examples, but is not limited thereto. Note that, "part(s)" means "part(s) by mass."

A molecular weight distribution and a Ca content with EDS were measured in the following Examples as follows.

[Measurement of Molecular Weight Distribution]

A column was stabilized in a heat chamber at 40° C. As a solvent, THF was streamed into the column at this temperature at a flow velocity of 1 mL per minute, and a THF sample solution of a toner or resin in which a sample concentration had been adjusted to 0.05% by mass to 0.6% by mass, was injected at 50 μL to 200 μL for measurement.

In order to measure the molecular weight of the sample, the molecular weight distribution of the sample was calculated from the correlation between the logarithmic values and the number of counts of the standard curve that was prepared from the standard samples of various monodisperse polystyrenes.

As the standard polystyrene samples used for the standard curve, it is appropriate to use those with a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ manufactured by, for instance, Pressure Chemical Co. or TOSOH CORPORATION, and to use at least about ten standard polystyrene samples. An RI (refractive index) detector was used as a detector therefor.

[Measurement of Ca Content with EDS]

OPC80AJ (manufactured by Filgen, Inc.) was used as a coating device and MWRIN (manufactured by Carl Zeiss AG) was used as a measurement device.

Various parameters were set as follows:

Accelerating voltage: 10 kV (Voltage for Accelerating Detecting Electrons in Irradiation Device)

Operating distance: 14.05 mm (Distance from Irradiation Device to Sample)

Live time limit: 100 sec (Measurement Time. The Longer it is, the Higher Detection Precision is.)

Time constant: 30

(Detection Time. It Affects Detection Sensitivity of EDS.)

Dead time: 20 to 30

(Proportion of Time for which Detection is not Performed Relative to Overall Incidence Time.)

Irradiation current: 170 pA (Current Applied Upon Releasing Electrons from Electrode)

Resolution (mapping): 256×192

Frame time (mapping): the fastest

Frame number (mapping): 10,000 or more

Resolution (image tab): 512×384

Frame time (image tab): 5.0

Frame number (image tab): 1

The measurement was performed as follows:

1) A toner (about 10 mg) was adhered to a piece of a carbon tape.

2) The toner on the tape was subjected to a Os coating in a chamber.

3) Various parameters were set.

4) Measurement was performed (Contents of elements, i.e., C, O, and Ca were measured and the proportion (in % by mass) of the Ca content relative to the total thereof was detected.).

5) The above measurement was repeated 10 times and an average value of the resulting values was determined as the Ca content (% by mass).

<Synthesis of Polyester Resin A1>

Carboxylic acid components and alcohol components described in Table 1 were subjected to esterification reaction under normal pressure at 170° C. to 260° C. in the absence of a catalyst. Then, antimony trioxide was added to the reaction system at a concentration of 400 ppm with respect to the total carboxylic acid components and subjected to condensation polymerization at 250° C. under a vacuum of 3 Torr with glycol being removed out of the system, to thereby obtain a resin. Here, the crosslinking reaction was performed until the stirring torque reached 10 kg·cm (100 ppm), and the reaction was terminated by releasing the vacuum condition of the reaction system to thereby obtain Polyester resin A1.

<Synthesis of Polyester Resins B1 to B6>

Polyester resins B1 to B6 were obtained in the same manner as in <Synthesis of Polyester resin A1>, except that the carboxylic acid components and the alcohol components were changed to those described in Table 2. Polyester resins B1 to B6 were measured for the molecular weight distribution according the above-described method. Measurement results are shown in Table 2.

<Synthesis of Composite Resin C>

Composite resin C consisting of a condensation polymerization unit and an addition polymerization unit was synthesized as follows.

In a 5 L four-necked flask equipped with a nitrogen inlet tube, a dehydration tube, a stirrer, a dropping funnel and a thermocouple, 0.8 mol of terephthalic acid, 0.6 mol of fumaric acid, 0.8 mol of trimellitic anhydride, 1.1 mol of bisphenol A (2,2) propylene oxide, 0.5 mol of bisphenol A (2,2) ethylene oxide, and 9.5 mol of dibutyl tin oxide serving as an esterification catalyst were placed. It was heated to 135° C. in a nitrogen atmosphere.

Then, 10.5 mol of styrene, 3 mol of acrylic acid and 1.5 mol of 2-ethyl hexylacrylate serving as addition polymerization monomers constituting the addition polymerization unit and 0.24 mol of t-butyl hydroperoxide serving as a polymerization initiator were placed in the dropping funnel with stirring to thereby obtain a mixture. The resultant mixture was added dropwise for 5 hours, followed by allowing to react for 6 hours.

Then, the reaction system was raised in temperature to 210° C. for 3 hours, and allowed to react at 210° C. and 10 kPa until reaching a desired softening point to thereby synthesize Composite resin C.

The resultant Composite resin C was found to have a softening temperature of 115° C., a glass transition temperature of 58° C., and an acid value of 25 mgKOH/g.

TABLE 1

| Resin A | Material | Acid component | Alcohol component |
|---|---|---|---|
| A1 | Polyester | Fumaric acid<br>Trimellitic anhydride | Bisphenol A (2,2) propylene oxide<br>Bisphenol A (2,2) ethylene oxide |

TABLE 2

| Resin B | Material | Molecular weight distribution: Main peak | Molecular weight distribution: Half value width | Acid component | Alcohol component |
|---|---|---|---|---|---|
| B1 | Polyester | 800 | 17000 | Fumaric acid | Bisphenol A (2,2) propylene oxide<br>Bisphenol A (2,2) ethylene oxide |
| B2 | Polyester | 5000 | 17000 | Fumaric acid | Bisphenol A (2,2) propylene oxide<br>Bisphenol A (2,2) ethylene oxide |
| B3 | Polyester | 11000 | 18000 | Fumaric acid | Bisphenol A (2,2) propylene oxide<br>Bisphenol A (2,2) ethylene oxide |
| B4 | Polyester | 5000 | 22000 | Fumaric acid | Bisphenol A (2,2) propylene oxide<br>Bisphenol A (2,2) ethylene oxide |
| B5 | Polyester | 7500 | 28000 | Fumaric acid | Bisphenol A (2,2) propylene oxide<br>Bisphenol A (2,2) ethylene oxide |
| B6 | Polyester | 1500 | 7000 | Fumaric acid | Bisphenol A (2,2) propylene oxide<br>Bisphenol A (2,2) ethylene oxide |

Example 1

Production of Pulverized Toner

<<Formulation of Toner 1>>

Polyester resin A1: 26 parts by mass
Polyester resin B2: 31 parts by mass
Composite resin C: 10 parts by mass
Colorant (carbon black): 9 parts by mass
Release agent 4 parts by mass
(Carnauba wax; melting point: 81° C.)
Charging controlling agent 1 part by mass
(Monoazometal complex)
(Chromium complex salt dye, BONTRON S-34, manufactured by Orient Chemical Industries Co., Ltd.)
Calcium carbonate 20 parts by mass (SOFTEN-3200, manufactured by BIHOKU FUNKA KOGYO CO., LTD.)

Toner raw materials were premixed in accordance with the above formulations presented in the following Table 3-1 using HENSCHEL MIXER (FM20B, manufactured by Mitsui Miike Machinery Co., Ltd.) and then melt-kneaded at a temperature of 120° C. using a biaxial kneader (PCM-30, manufactured by IKEGAI LTD.). The resultant kneaded product was rolled to a thickness of 2.7 mm with a roller, then cooled to room temperature by a belt cooler and finally coarsely pulverized to 200 μm to 300 μm using a hammer mill. The resultant was then finely pulverized using a supersonic jet mill LABOJET (manufactured by Nippon Pneumatic Mfg. Co., Ltd.) and classified using a dispersion separator (MDS-I, manufactured by Nippon Pneumatic Mfg. Co., Ltd.) while appropriately adjusting the opening of louvers so that the mass average particle diameter of the classified product was 6.9 μm±0.2 μm, to thereby obtain toner base particles.

Then, 1.0 part by mass of additives (HDK-2000, manufactured by Clariant K.K.) and 100 parts by mass of the toner base particles were stirred and mixed together using HENSCHEL MIXER to thereby produce Toner 1.

Toner 1 were measured for the molecular weight distribution (main peak, half value width) and Ca content of the according to the above-described method. Results are shown in Table 3-2.

Next, 5% by mass of Toner 1 and 95% by mass of a coating ferrite carrier were uniformly mixed using TURBULA MIXER (manufactured by Willy A. Bachofen AG Maschinenfabrik) at 48 rpm for 5 min, to thereby produce Developer 1.

An image forming apparatus containing Developer 1 was used to evaluate low-temperature fixing property, hot-offset resistance, heat resistance storage stability, and charging property according to the below-described evaluation methods. Results are shown in Table 4.

<Evaluation of Low-Temperature Fixing Property and Hot-Offset Resistance>

Using the copier (IMAGIO MP6002, manufactured by Ricoh Company, Ltd.), an image was printed using the [Developer 1].

A solid image with a deposited amount of 0.4 mg/cm$^2$ was printed on a sheet of paper (TYPE6200, manufactured by Ricoh Company, Ltd.) through exposing, developing and transfer steps. A linear velocity of fixing was set to 180 mm/sec. Images were printed with a fixing temperature increasing in increment of 5° C. to thereby determine a lower-limit temperature (lower-limit fixing temperature: low-temperature fixing property) where no cold offset occurs and an upper-limit temperature (upper-limit fixing temperature: hot offset resistance) where no hot offset occurs. An NIP width of the fixing device was 11 mm.

—Evaluation Criteria of Low-Temperature Fixing Property—

A: less than 130° C.
B: 130° C. or higher but less than 140° C.
C: 140° C. or higher but less than 150° C.
D: 150° C. or higher but less than 160° C.
E: 160° C. or higher —Evaluation Criteria of Hot-Offset Resistance—

A: 200° C. or higher
B: 190° C. or higher but less than 200° C.
C: 180° C. or higher but less than 190° C.
D: 170° C. or higher but less than 180° C.
E: less than 170° C.

<Heat Resistance Storage Stability>

In a 30 mL screw-top vial, 10 g of the toner was placed. The vial was tapped 100 times with a tapping machine and then stored in a thermostat at 50° C. for 24 hours. The vial was cooled to room temperature, and the toner was measured for its penetration using a penetration testing machine as an evaluation of heat resistance storage stability.

—Evaluation Criteria of Heat Resistance Storage Stability—

A: complete penetration
B: 25 mm or greater
C: 20 mm or greater but less than 25 mm
D: 15 mm or greater but less than 20 mm
E: less than 15 mm <Charging Property>

The developing step was terminated during developing of a blank image. The developer on the photoconductor which had been developed was transferred to a tape. A difference in image density with an untransferred tape was determined by 938 SPECTRODENSITOMETER (manufactured by X-Rite).

—Evaluation Criteria of Charging Property—

A: The difference is less than 0.005.
B: The difference is 0.005 or more but less than 0.010.

C: The difference is 0.010 or more but less than 0.015.
D: The difference is 0.015 or more but less than 0.020.
E: The difference is 0.020 or more but less than 0.025.
F: The difference is 0.025 or more but less than 0.030.
G: The difference is 0.030 or more.

Examples 2 to 22

Toners 2 to 22 were produced in the same manner as in the production method of Toner 1 described in Example 1, except that toner raw materials were incorporated as described in Table 3-1, a temperature condition during melt-kneading was changed to 130° C. for Examples 8 and 15, to 140° C. for Examples 10 and 16, and to 150° C. for Examples 11 and 17.

Each of Toners 2 to 22 was measured for the molecular weight distribution (main peak, half value width) and the Ca content in the same manner as in Toner 1. Results are shown in Table 3-2.

Developers 2 to 22 corresponding to Toner 2 to 22 were produced from Toners 2 to 22 in the same manner as in Example 1.

The image forming apparatus containing each of Developers 2 to 22 were used to evaluate low-temperature fixing property, hot-offset resistance, heat resistance storage stability, and charging property in the case of using each of Developers 2 to 22 in the same manner as in Example 1. Results are shown in Table 4.

Comparative Examples 1 to 6

Comparative toners 1 to 6 were produced in the same manner as in the production method of Toner 1 described in Example 1, except that toner raw materials were incorporated as described in Table 3-1.

Each of Comparative toners 1 to 6 was measured for the molecular weight distribution (main peak, half value width) and the Ca content in the same manner as in Toner 1. Results are shown in Table 3-2.

Comparative developers 1 to 6 corresponding to Comparative toner 1 to 6 were produced from Comparative toner 1 to 6 in the same manner as in Example 1.

The image forming apparatus containing each of the Comparative developers 1 to 6 was used to evaluate low-temperature fixing property, hot-offset resistance, heat resistance storage stability, and charging property in the case of using each of Comparative developers 1 to 6 in the same manner as in Example 1. Results are shown in Table 4.

TABLE 3-1

| | Formulation | | | | | | |
|---|---|---|---|---|---|---|---|
| | Resin A | | Resin B | | Composite resin C | | Calcium carbonate |
| | Type | Content [part by mass] | Type | Content [part by mass] | Type | Content [part by mass] | Content [part by mass] |
| Ex. 1 | A1 | 26 | B2 | 31 | C | 10 | 20 |
| Ex. 2 | A1 | 32 | B2 | 38 | C | 10 | 7 |
| Ex. 3 | A1 | 20 | B2 | 24 | C | 10 | 33 |
| Ex. 4 | A1 | 30 | B2 | 35 | C | 10 | 12 |
| Ex. 5 | A1 | 22 | B2 | 27 | C | 10 | 28 |
| Ex. 6 | A1 | 21 | B5 | 26 | C | 10 | 30 |
| Ex. 7 | A1 | 32 | B5 | 40 | C | 10 | 5 |
| Ex. 8 | A1 | 21 | B5 | 26 | C | 10 | 30 |
| Ex. 9 | A1 | 32 | B5 | 38 | C | 10 | 7 |
| Ex. 10 | A1 | 21 | B5 | 26 | C | 10 | 30 |
| Ex. 11 | A1 | 21 | B5 | 26 | C | 10 | 30 |
| Ex. 12 | A1 | 31 | B5 | 36 | C | 10 | 10 |
| Ex. 13 | A1 | 26 | B3 | 31 | C | 10 | 20 |
| Ex. 14 | A1 | 21 | B3 | 26 | C | 10 | 30 |
| Ex. 15 | A1 | 21 | B3 | 26 | C | 10 | 30 |
| Ex. 16 | A1 | 21 | B3 | 26 | C | 10 | 30 |
| Ex. 17 | A1 | 21 | B3 | 26 | C | 10 | 30 |
| Ex. 18 | A1 | 32 | B3 | 38 | C | 10 | 7 |
| Ex. 19 | A1 | 33 | B3 | 39 | C | 10 | 5 |
| Ex. 20 | A1 | 26 | B3 | 31 | C | 10 | 20 |
| Ex. 21 | A1 | 23 | B2 | 27 | C | 10 | 27 |
| Ex. 22 | A1 | 26 | B6 | 31 | C | 10 | 20 |
| Comp. Ex. 1 | A1 | 26 | B1 | 31 | C | 10 | 20 |
| Comp. Ex. 2 | A1 | 26 | B3 | 31 | C | 10 | 20 |
| Comp. Ex. 3 | A1 | 26 | B5 | 31 | C | 10 | 20 |
| Comp. Ex. 4 | A1 | 33 | B2 | 40 | C | 10 | 4 |
| Comp. Ex. 5 | A1 | 17 | B3 | 20 | C | 10 | 40 |
| Comp. Ex. 6 | A1 | 26 | B6 | 31 | C | 10 | 20 |

TABLE 3-2

| | Physical properties of toner | | |
|---|---|---|---|
| | Main peak | Half value width | Ca content (% by mass) |
| Ex. 1 | 5900 | 17700 | 13.0 |
| Ex. 2 | 6600 | 18100 | 4.7 |
| Ex. 3 | 5000 | 17300 | 23.7 |
| Ex. 4 | 6400 | 17900 | 8.2 |
| Ex. 5 | 5600 | 17700 | 19.6 |
| Ex. 6 | 8500 | 29000 | 62.0 |
| Ex. 7 | 8500 | 29000 | 0.9 |
| Ex. 8 | 8500 | 29000 | 59.0 |
| Ex. 9 | 8500 | 29000 | 1.0 |
| Ex. 10 | 8500 | 29000 | 32.0 |
| Ex. 11 | 8500 | 29000 | 28.0 |
| Ex. 12 | 8500 | 29000 | 6.0 |
| Ex. 13 | 6700 | 20000 | 13.0 |
| Ex. 14 | 5000 | 17300 | 61.0 |
| Ex. 15 | 5600 | 17700 | 57.0 |
| Ex. 16 | 5600 | 17700 | 31.0 |
| Ex. 17 | 5600 | 17700 | 27.0 |
| Ex. 18 | 6600 | 18100 | 1.0 |
| Ex. 19 | 6600 | 18100 | 5.0 |
| Ex. 20 | 6100 | 17800 | 13.0 |
| Ex. 21 | 5600 | 17600 | 0.5 |
| Ex. 22 | 2500 | 8000 | 12.6 |
| Comp. Ex. 1 | 500 | 18000 | 12.9 |
| Comp. Ex. 2 | 10500 | 19000 | 13.6 |
| Comp. Ex. 3 | 8500 | 32000 | 12.6 |
| Comp. Ex. 4 | 7100 | 18400 | 2.1 |
| Comp. Ex. 5 | 4800 | 17200 | 52.1 |
| Comp. Ex. 6 | 2000 | 7500 | 12.6 |

TABLE 4

| | Effect Evaluation results | | | |
|---|---|---|---|---|
| | Low-temperature fixing property | Hot-offset property | Heat resistance storage stability | Charging property |
| Ex. 1 | A | A | B | B |
| Ex. 2 | A | B | C | B |
| Ex. 3 | A | A | B | B |
| Ex. 4 | A | A | B | B |
| Ex. 5 | A | A | B | B |
| Ex. 6 | D | D | A | F |
| Ex. 7 | B | D | D | B |
| Ex. 8 | C | B | B | D |
| Ex. 9 | B | D | C | B |
| Ex. 10 | C | B | B | D |
| Ex. 11 | B | A | B | B |
| Ex. 12 | B | A | B | B |
| Ex. 13 | A | A | B | B |
| Ex. 14 | D | D | A | F |
| Ex. 15 | B | B | B | D |
| Ex. 16 | B | B | B | D |
| Ex. 17 | A | A | B | B |
| Ex. 18 | A | D | C | B |
| Ex. 19 | A | A | B | B |
| Ex. 20 | A | A | B | B |
| Ex. 21 | A | D | D | B |
| Ex. 22 | A | A | B | B |
| Comp. Ex. 1 | B | E | E | B |
| Comp. Ex. 2 | E | A | B | B |
| Comp. Ex. 3 | E | D | D | B |
| Comp. Ex. 4 | B | E | D | B |
| Comp. Ex. 5 | E | E | B | D |
| Comp. Ex. 6 | B | E | B | B |

As can be seen from the above, the present invention can provide a toner that has all of extremely excellent low-temperature fixing property, high hot-offset resistance, and good storage stability and that can form high-quality images for a long period of time.

Embodiments of the present invention are as follows:

<1> A toner, including:

a binder resin; and calcium carbonate, wherein the toner has a molecular weight distribution having a main peak in a range of 1,000 to 10,000, and a half value width of the main peak is 8,000 to 30,000, where the molecular weight distribution is obtained by GPC (gel permeation chromatography) of THF soluble matter of the toner, and wherein the toner contains the calcium carbonate in an amount of 5% by mass to 35% by mass.

<2> The toner according to <1>, wherein a Ca content is 1% by mass to 60% by mass as measured for contents of elements C, O, and Ca in the toner with EDS (energy dispersive X-ray spectrometry).

<3> The toner according to <1> or <2>, wherein the Ca content is 5% by mass to 30% by mass as measured for the contents of the elements C, O, and Ca in the toner with EDS (energy dispersive X-ray spectrometry).

<4> The toner according to any one of <1> to <3>, wherein the half value width of the main peak is 8,000 to 20,000.

<5> An image forming apparatus, including:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer to thereby form a toner image, wherein the toner is the toner according to any one of <1> to <4>.

<6> An image forming method, including:

forming an electrostatic latent image on an electrostatic latent image bearer; and developing with a toner the electrostatic latent image formed on the electrostatic latent image bearer to thereby form a toner image, wherein the toner is the toner according to any one of <1> to <4>.

<7> A process cartridge, including:

an electrostatic latent image bearer; and a developing unit containing a toner and configured to develop an electrostatic latent image formed on the electrostatic latent image bearer to thereby form a toner image, wherein the electrostatic latent image bearer and the developing unit are integrally supported, and wherein the toner is the toner according to any one of <1> to <4>.

REFERENCE SIGNS LIST

10 Electrostatic latent image bearer
21 Exposing device
25 Fixing device
61 Developing device
160 Charging device

The invention claimed is:

1. A toner, comprising:

a binder resin; and calcium carbonate, wherein the binder resin comprises at least a polyester resin and a composite resin (C), wherein the composite resin is a resin where a condensation polymerization monomer and an addition polymerization monomer are chemically bonded together, wherein the toner has a molecular weight distribution having a main peak in a range of 1,000 to 10,000, and a half value width of the main peak is 17,300 to 30,000, where the molecular weight distribution is obtained by gel permeation chromatography of THF soluble matter of the toner, wherein the toner comprises calcium carbonate in an amount of 5% by mass to 35% by mass, wherein the Ca content is 5% by mass to 30% by mass as measured for the contents of the elements C, O, and Ca in the toner with energy dispersive X-ray spectrometry (EDS), wherein the polyester resin comprises at least a polyester resin (A) and a polyester resin (B), and wherein the polyester resin (A) has a softening temperature (T½) higher than a softening temperature of the polyester resin (B).

2. The toner according to claim 1, wherein the half value width of the main peak is 17,300 to 20,000.

3. An image forming apparatus, comprising:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer to thereby form a toner image, wherein the toner is the toner according to claim 1.

4. An image forming method, comprising:

forming an electrostatic latent image on an electrostatic latent image bearer; and developing with a toner the electrostatic latent image formed on the electrostatic latent image bearer to thereby form a toner image, wherein the toner is the toner according to claim 1.

5. A process cartridge, comprising:

an electrostatic latent image bearer; and a developing unit containing a toner and configured to develop an electrostatic latent image formed on the electrostatic latent image bearer to thereby form a toner image, wherein the electrostatic latent image bearer and the developing unit are integrally supported, and wherein the toner is the toner according to claim 1.

6. The toner according to claim 1, wherein the softening temperature (T½) of the polyester resin (A) is in a range of 120° C. to 180° C., wherein the softening temperature (T½) of the polyester resin (B) is in a range of 70° C. to 120° C., wherein the softening temperature (T½) of the composite resin (C) is in a range of 90° C. to 130° C.

7. The toner according to claim 1, comprising:

20 to 33 mass % of polyester resin (A), 24 to 40 mass % of polyester resin (B), 1 to 10 mass % of composite resin (C), and 5 to 35 mass % of calcium carbonate, based on 100 mass % of the toner.

* * * * *